US006945009B2

(12) United States Patent
Spatafora et al.

(10) Patent No.: US 6,945,009 B2
(45) Date of Patent: Sep. 20, 2005

(54) OPERATING WHEEL OF A PRODUCT PACKING MACHINE

(75) Inventors: Mario Spatafora, Granarolo (IT); Alver Tacchi, Bologna (IT)

(73) Assignee: G.D. Societa' per Azioni, Bologna (IT)

( * ) Notice: Subject to any disclaimer, the term of this patent is extended or adjusted under 35 U.S.C. 154(b) by 0 days.

(21) Appl. No.: 10/901,225

(22) Filed: Jul. 29, 2004

(65) Prior Publication Data

US 2005/0086908 A1 Apr. 28, 2005

(30) Foreign Application Priority Data

Aug. 1, 2003 (IT) ..... BO2003A0472

(51) Int. Cl.[7] ..... B65B 57/00
(52) U.S. Cl. ..... 53/77; 53/232; 53/234
(58) Field of Search ..... 53/77, 228, 232, 53/233, 234, 466; 198/431, 450

(56) References Cited

U.S. PATENT DOCUMENTS

| | | | | |
|---|---|---|---|---|
| 3,885,374 A | * | 5/1975 | Schmermund | 53/234 |
| 4,221,287 A | * | 9/1980 | Seragnoli | 198/431 |
| 4,519,180 A | | 5/1985 | Maure et al. | |
| 5,097,940 A | * | 3/1992 | Manservigi et al. | 198/450 |
| 5,394,970 A | * | 3/1995 | Boriani et al. | 198/431 |
| 5,657,609 A | * | 8/1997 | Spada et al. | 53/234 |
| 5,732,533 A | * | 3/1998 | Focke et al. | 53/234 |
| 6,035,612 A | * | 3/2000 | Draghetti et al. | 53/234 |
| 6,047,529 A | * | 4/2000 | Draghetti | 53/234 |
| 6,510,671 B2 | * | 1/2003 | Focke et al. | 53/234 |

FOREIGN PATENT DOCUMENTS

| | | |
|---|---|---|
| DE | 195 35 510 A1 | 3/1997 |
| EP | 0 792 807 A1 | 9/1997 |
| EP | 0 811 555 A1 | 12/1997 |
| EP | 1 211 178 A1 | 6/2002 |

* cited by examiner

*Primary Examiner*—Louis Huynh
(74) *Attorney, Agent, or Firm*—Birch, Stewart, Kolasch & Birch, LLP

(57) ABSTRACT

An operating wheel of a packing machine comprises an annular drum, a number of through pockets carried by the annular drum and each for receiving a respective product, a first drive for rotating the annular drum in steps to feed the pockets along an annular path extending through a loading station and an unloading station, first and second pusher for engaging respective pockets at the loading station and the unloading station respectively, a second electric drive for imparting to the pushers respective substantially radial reciprocating movements to and from respective withdrawn rest positions inside the annular drum and through the respective pockets, a first safety device for preventing the annular drum from rotating when at least one of the pushers engages a respective pocket, and a second safety device for preventing the pushers from moving from the respective withdrawn positions when the annular drum is rotating.

14 Claims, 5 Drawing Sheets

OPERATING WHEEL OF A PRODUCT PACKING MACHINE

This Non-provisional application claims priority under 35 U.S.C. § 119(a) on Patent Application No(s). BO2003A 000472 filed in Italy on Aug. 1, 2003, the entire contents of which are hereby incorporated by reference.

The present invention relates to an operating wheel of a product packing machine.

More specifically, the present invention relates to an operating wheel, of a product packing machine, of the type comprising a fixed central body having a longitudinal taxis; an annular drum coaxial with the longitudinal axis and surrounding the central body; a number of through pockets on the annular drum, each for receiving a relative product; first drive means for rotating the annular drum in steps about the longitudinal axis to feed the pockets along an annular path extending through a product loading station and a product unloading station; first and second push means carried by the central body and for engaging respective pockets at the loading station and unloading station respectively; and further drive means for imparting to the push means respective reciprocating movements to and from respective withdrawn rest positions inside the annular drum and along respective paths substantially radial with respect to the longitudinal axis and extending through the respective pockets.

Though suitable for packing any product, in particular a substantially parallelepiped-shaped product, the present invention may be used to advantage in the tobacco industry for producing a packing wheel for packing packets of cigarettes into cartons on a cartoning machine, to which the following description refers purely by way of example.

BACKGROUND OF THE INVENTION

A cartoning machine is known to employ at least one operating wheel, in this case a packing wheel, of the above type, in which the annular drum is driven, via a mechanical transmission, by a main motor of the cartoning machine, and the push means carried by the central body of the packing wheel are operated by mechanical actuating devices which are also normally connected to the main motor by cam control devices.

Not only, therefore, is the structure of known operating wheels of the above type seriously complicated by the mechanical actuating devices, but any change in format necessarily means changing the cam control devices, thus involving fairly prolonged downtime.

SUMMARY OF THE INVENTION

It is an object of the present invention to provide an operating wheel of a product packing machine, designed to eliminate the aforementioned drawbacks.

According to the present invention, there is provided an operating wheel of a packing machine for packing products, the operating wheel comprising a fixed central body having a longitudinal axis; an annular drum coaxial with said longitudinal axis and surrounding said central body; a number of through pockets carried by said annular drum and each for receiving a relative said product; first drive means for rotating said annular drum in steps about said longitudinal axis to feed said pockets along an annular path extending through a loading station and an unloading station for respectively loading and unloading said products; first and second push means carried by said central body and for engaging respective said pockets at said loading station and said unloading station respectively; and second drive means for imparting to said push means respective substantially radial reciprocating movements to and from respective withdrawn rest positions inside said annular drum and through said respective pockets; the operating wheel being characterized in that at least said second drive means are electric drive means; and by comprising a first safety device for preventing said annular drum from rotating about said longitudinal axis when at least one of said push means engages a said respective pocket; and a second safety device for preventing said push means from moving from the respective said withdrawn positions when said annular drum is rotating about said longitudinal axis.

The mechanical safety devices referred to above are necessary on account of employing electric said second drive means, and of the position control of an electric motor being subject, albeit rarely, to inaccuracy caused, among other things, by internal read errors and/or external factors, such as an external magnetic field.

The operating wheel defined above is preferably formed as claimed in any one of the Claims depending directly or indirectly on Claim 1.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
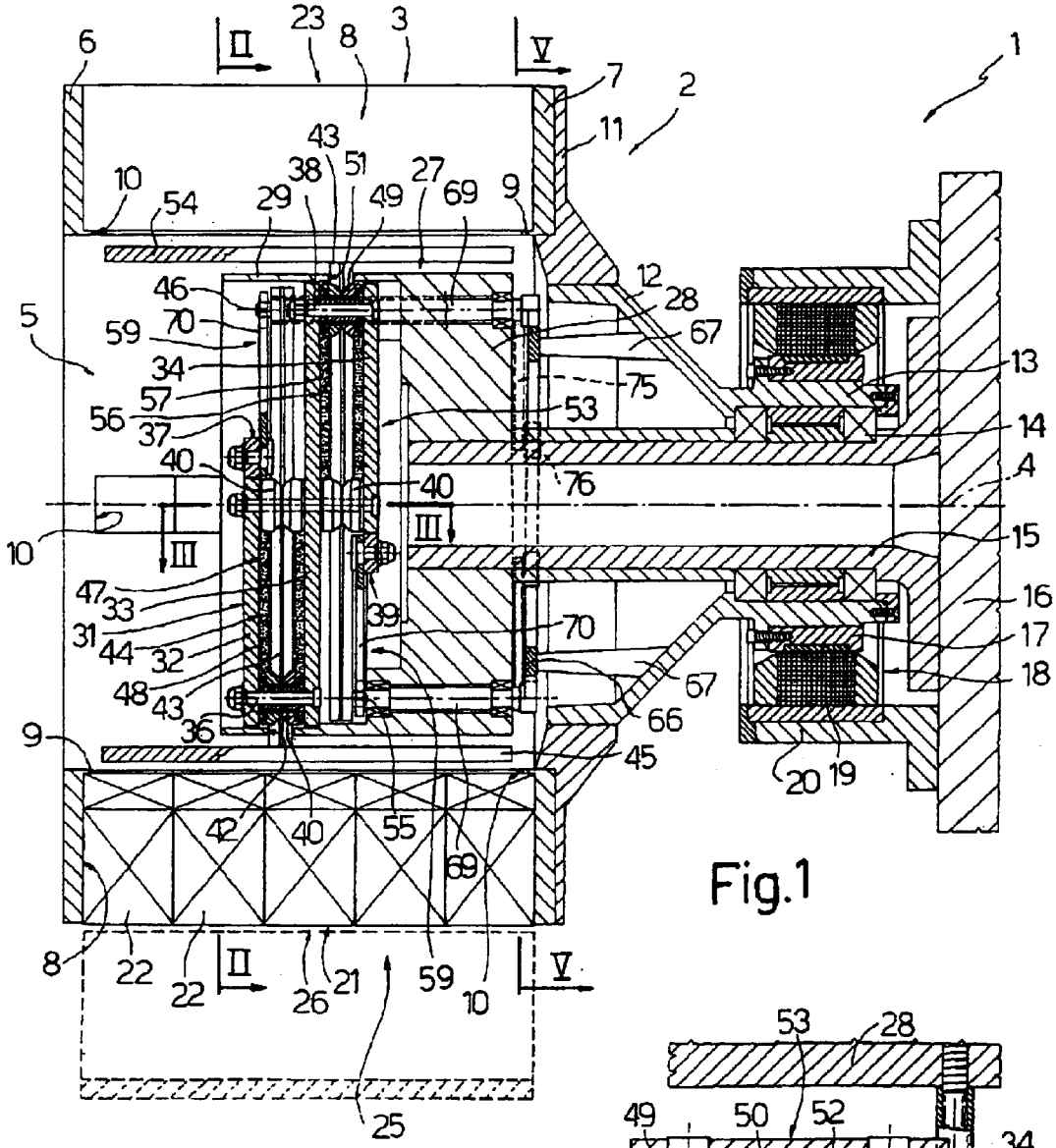
FIG. 1 shows an axial section of a first preferred embodiment of the packing wheel according to the present invention.
Figure 3:
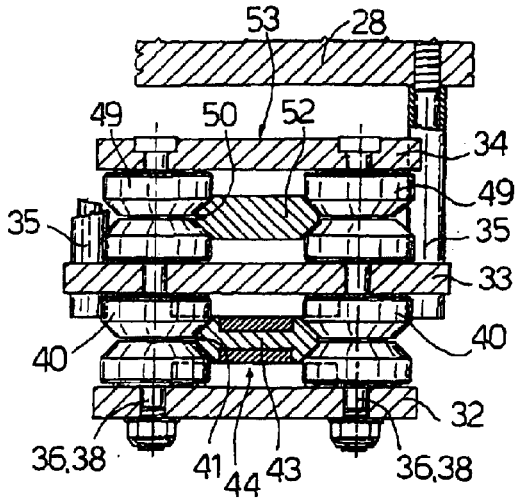
FIG. 3 shows a larger-scale section along line III—III in FIG. 1.
Figure 2:
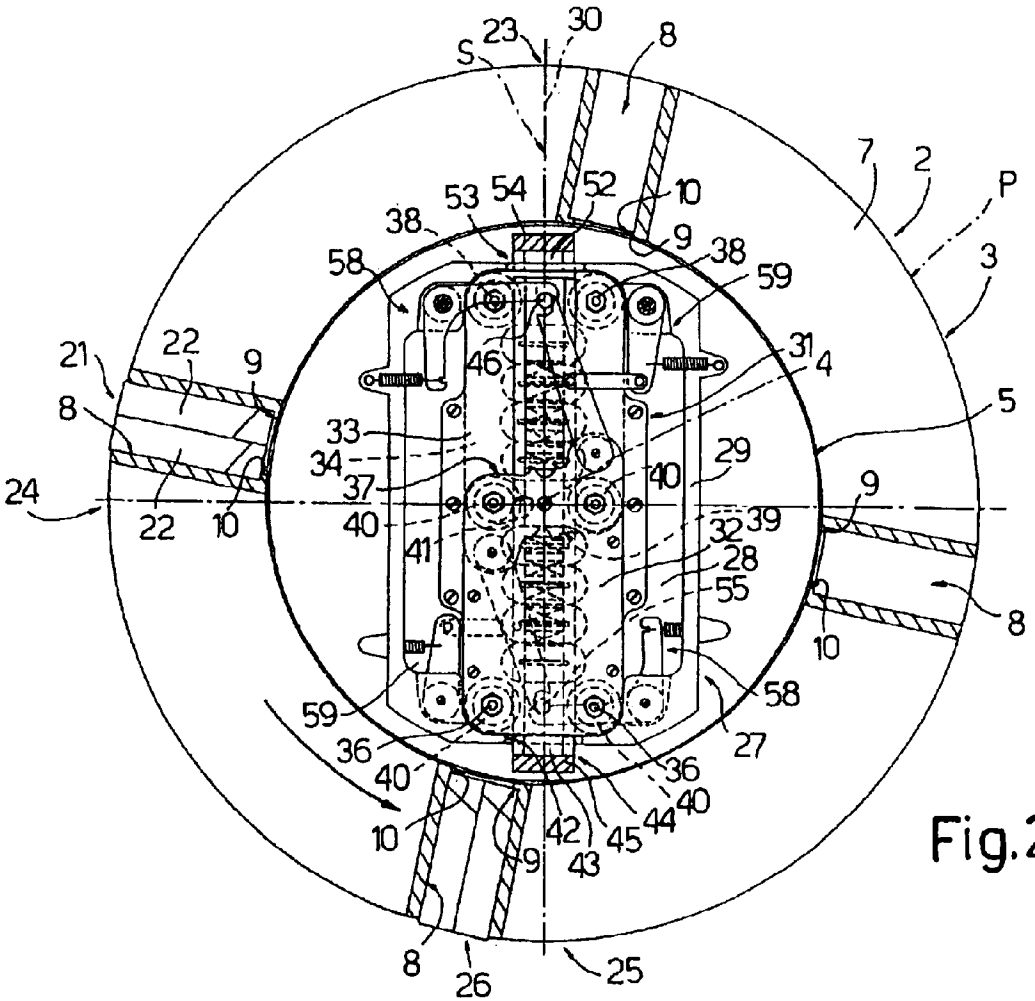
FIG. 2 shows a section along line II—II in FIG. 1.

With reference to FIGS. 1 to 3, number 1 indicates as a whole a cartoning machine comprising an operating wheel—in the example shown, a packing wheel 2—in turn comprising an annular drum 3 rotating in steps about a longitudinal axis 4, and a fixed central body 5 inside annular drum 3 and coaxial with longitudinal axis 4. Annular drum 3 comprises a front annular flange 6 and a rear annular flange 7, which are coaxial with longitudinal axis 4 and connected to each other by a number of substantially U-shaped longitudinal pockets 8. Each pocket 8 is positioned with its concavity facing radially outwards, and is closed inwards by a bottom wall 9 having a central opening 10.

With reference to FIG. 1, a counterflange 11 is connected to rear annular flange 7, and extends outwards from the open front end of a substantially truncated-cone-shaped transmission casing 12 coaxial with longitudinal axis 4, and from the rear end of which a cylindrical sleeve 13 extends rearwards, coaxially with longitudinal axis 4. Sleeve 13 is fitted in rotary manner, via the interposition of a bearing 14, to the outer surface of a cylindrical tube 15, which extends frontwards from a fixed frame 16 of cartoning machine 1, through transmission casing 12 and coaxially with longitudinal axis 4, and is fitted on its front end with central body 5.

To the outer surface of sleeve 13 is fitted an annular rotor 17 of an electric motor 18, which is coaxial with longitudinal axis 4, and comprises an annular stator 19 fitted to the inner surface of an annular body 20 coaxial with longitudinal axis 4 and integral with frame 16.

Each pocket 8 receives a respective group 21 of packets 22 of cigarettes and a respective sheet of packing material (not shown) in known manner at a loading station 23, and moves, anticlockwise in FIG. 2, along an annular path P extending through loading station 23, at least one known folding station 24, and an unloading station 25 diametrically opposite loading station 23, to feed a respective at least partly closed carton 26 to unloading station 25.

With reference to FIG. 1, central body 5 comprises a cup-shaped body 27 located in front of transmission casing 12 and inside annular drum 3, and in turn comprising an end wall 28 perpendicular to longitudinal axis 4 and fitted to the free front end of tube 15 to face the open front end of transmission casing 12; and a lateral wall 29 projecting, parallel to and coaxially with longitudinal axis 4, from the front surface of end wall 28, and having an annular, substantially rectangular cross section, a longitudinal axis 30 of which is perpendicular to longitudinal axis 4, and defines, with longitudinal axis 4, a plane S, which extends through loading station 23 and unloading station 25, and is substantially coincident with the FIG. 1 plane and perpendicular to the FIG. 2 plane.

With reference to FIG. 2, central body 5 also comprises a push device 31 located inside cup-shaped body 27, fitted to end wall 28, and comprising three superimposed, substantially rectangular plates 32, 33, 34, of which plate 32 is a front plate, plate 33 is an intermediate plate, and plate 34 is a rear plate. Plates 32–34 have respective planes parallel to one another and perpendicular to longitudinal axis 4, and respective longitudinal axes all lying in plane S. Intermediate plate 33 is substantially the same length as the portion of longitudinal axis 30 inside lateral wall 29, and, as shown in FIG. 3, is connected integrally to end wall 28 by a number of screw pins 35 parallel to longitudinal axis 4; front plate 32 is shorter in length than intermediate plate 33, is connected integrally to intermediate plate 33 by bolts 36, extends from the end of intermediate plate 33 facing unloading station 25, and is bounded, on the side facing loading station 23, by an edge 37 perpendicular to plane S; and rear plate 34 is the same length as front plate 32, is connected integrally to intermediate plate 33 by bolts 38, extends from the end of intermediate plate 33 facing loading station 23, and is bounded, on the side facing unloading station 25, by an edge 39 perpendicular to plane S.

Bolts 36 support for rotation respective grooved rollers 40 defining a guide 41 by which to support and slide a rod 43 of a pusher 44 in a direction parallel to longitudinal axis 30 and through an opening 42 formed through lateral wall 29 and facing unloading station 25; and a head 45 of pusher 44 is located outside lateral wall 29, facing unloading station 25. On the opposite end to that supporting head 45, rod 43 is fitted with a transverse pin 46 (shown in FIGS. 1 and 4) parallel to longitudinal axis 4 and cooperating with edge 37, and defines the movable member of a linear electric motor 47, the windings of a stator 48 of which are mounted between front plate 32 and intermediate plate 33.

Similarly, bolts 38 support for rotation respective grooved rollers 49 defining a guide 50 by which to support and slide a rod 52 of a pusher 53 in a direction parallel to longitudinal axis 30 and through an opening 51 formed through lateral wall 29 and facing loading station 23; and a head 54 of pusher 53 is located outside lateral wall 29, facing loading station 23. On the opposite end to that supporting head 54, rod 52 is fitted with a transverse pin 55 parallel to longitudinal axis 4 and cooperating with edge 39, and defines the movable member of a linear electric motor 56, the windings of a stator 57 of which are mounted between rear plate 34 and intermediate plate 33.

Linear electric motors 47 and 56 impart to relative pushers 44 and 53 respective reciprocating movements through relative openings 42 and 51, through openings 10 in relative stationary pockets 8 at unloading station 25 and loading station 23 respectively, and between respective withdrawn rest positions (FIGS. 1, 2, 4) wherein respective heads 45 and 54 are located inside annular drum 3, and respective extracted work positions (FIG. 6, only showing pusher 44) wherein respective rods 43 and 52 extend through respective stationary pockets 8 at unloading station 25 and loading station 23 respectively, respective heads 45 and 54 are aligned with the outer inlets of respective pockets 8, and pins 46 and 55 contact edge 37 of front plate 32 and edge 39 of rear plate 34 respectively.

As shown more clearly in FIG. 2, for each of pushers 44 and 53, central body 5 comprises two mechanical safety devices 58 and 59, of which safety device 58 prevents annular drum 3 from rotating about longitudinal axis 4 when relative pusher 44, 53 engages a respective pocket 8, and safety device 59 prevents relative pusher 44, 53 from interfering with annular drum 3 as annular drum 3 rotates about longitudinal axis 4.

Figure 5:
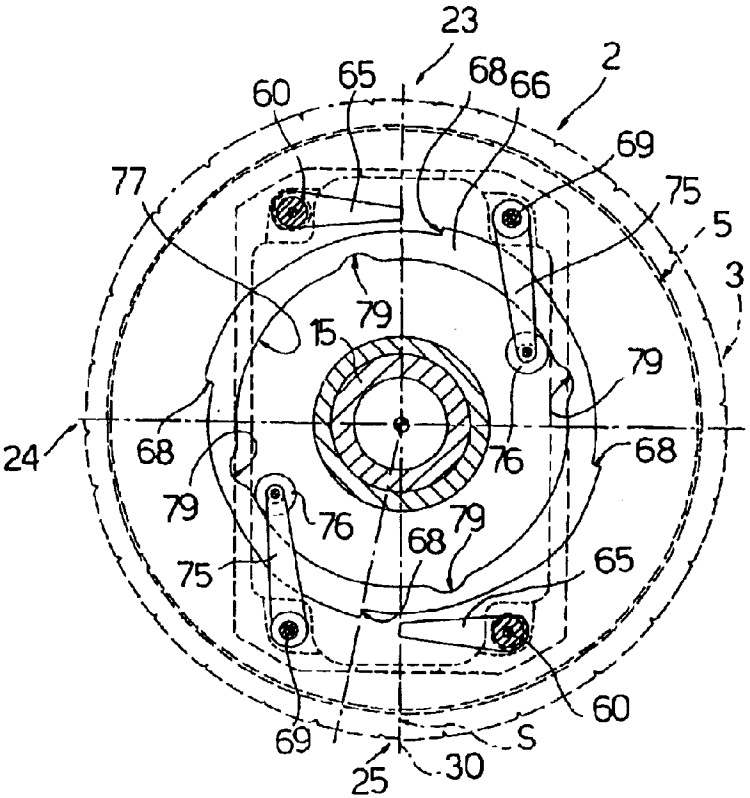
FIG. 5 shows a section along line V—V in FIG. 1 illustrating parts of FIG. 1 in the FIG. 4 operating position.
Figure 7:
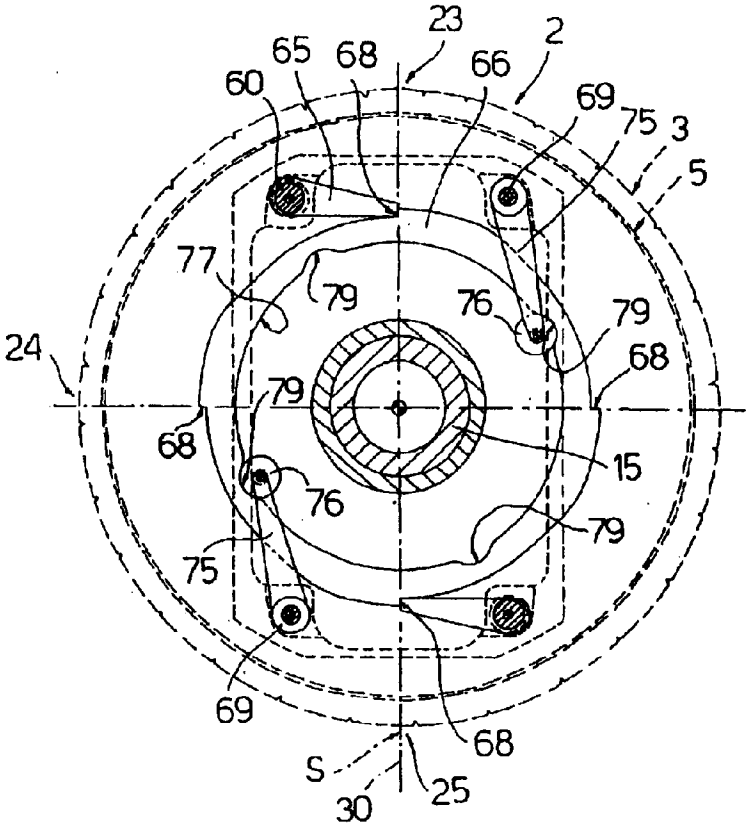
FIGS. 6 and 7 are similar to FIGS. 4 and 5, and show the FIGS. 4 and 5 parts in a second operating position.

As shown more clearly in FIGS. 4 to 7, each safety device 58 (only safety device 58 of pusher 44 is shown for the sake of simplicity) comprises a pin 60 which is fitted to cup-shaped body 27, parallel to longitudinal axis 4, is fitted in oscillating manner through a seat formed axially in lateral wall 29 and (FIG. 1) through end wall 28 of cup-shaped body 27, and defines the pivot of a respective substantially L-shaped rocker arm 61 fitted to pin 60 and comprising two arms 62 and 63. Arm 62 extends radially from relative pin 60 towards and through plane S, is positioned with a free end portion along the path of relative pin 46, 55, and interferes with pin 46, 55 when rod 43, 52 of pin 46, 55 nears the withdrawn rest position. Arm 63 is substantially perpendicular to relative arm 62, and is connected to lateral wall 29 by a spring 64 which tends to move the end portion of relative arm 62 towards relative edge 37, 39. As shown in FIGS. 5 and 7, each pin 60 is fitted, behind end wall 28, with a pawl 65 facing plane S and having a free end movable in plane S. Each pawl 65 is coplanar with an annular cam 66 which is coaxial with longitudinal axis 4, is connected integrally to transmission casing 12 by a number of radial arms 67 (FIG. 1), and has an outer profile onto which pawl 65 is pushed by relative spring 64, and which has a number of stop teeth 68 located at respective pockets 8.

Figure 4:
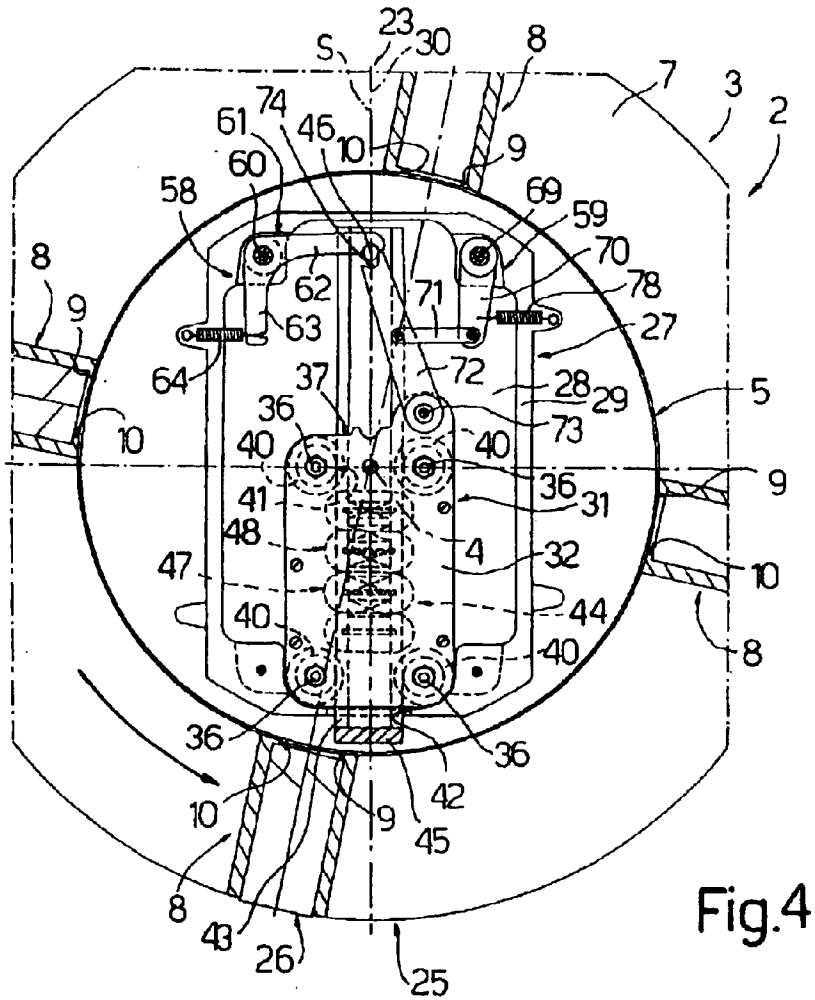
FIG. 4 is similar to FIG. 2, and shows an elevation, with parts removed for clarity, of parts of FIG. 1 in a first operating position.
Figure 6:
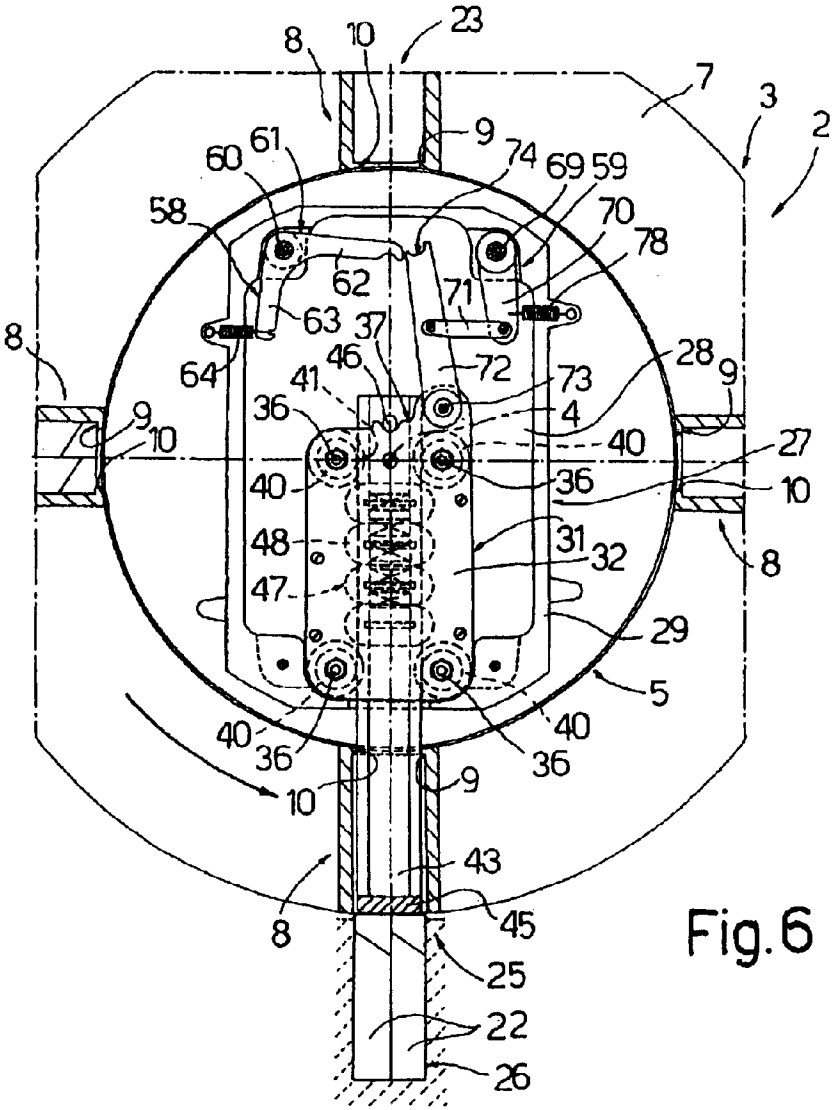

As shown in FIGS. 4 to 6, each safety device 59 (only safety device 59 of pusher 44 is shown for the sake of simplicity) comprises a pin 69 which is fitted to cup-shaped body 27, parallel to longitudinal axis 4, is fitted in oscillating manner (FIG. 1) through a seat formed axially in lateral wall 29 and (FIG. 1) through end wall 28 of cup-shaped body 27, and defines the pivot of a respective crank or lever 70 fitted to relative pin 69 and coplanar with relative rocker arm 61. The free end of each lever 70 is connected by a respective connecting rod 71 to an intermediate point of a further lever 72, which pivots on relative plate 32, 34 to oscillate about an axis 73 parallel to longitudinal axis 4, faces outwards towards plane S, and has, on its free end, a recess 74 for receiving relative pin 46, 55. As shown in FIGS. 5 and 7, each pin 69 is fitted, behind end wall 28 and in front of cam 66, with a further lever 75 fitted on its free end with a cam follower roller 76, which extends through cam 66 and is held contacting an inner profile 77 of cam 66 by a spring 78 arranged between relative lever 70 and lateral wall 29. Inner profile 77 is a circular profile coaxial with longitudinal axis 4, and having a number of recesses 79, each of which is associated with a relative tooth 68 and a relative pocket 8, and is engaged by a cam follower roller 76 when relative pawl 65 engages relative tooth 68.

Operation of packing wheel 2 will now be described as of the FIGS. 2, 4 and 5 operating position, in which annular drum 3 rotates to feed a first group 21, loaded previously at loading station 23, to folding station 24, and to feed a further group 21, already partly packed, to unloading station 25. In this situation, both pushers 44 and 53 are in their withdrawn rest positions, and relative pins 46 and 55 act on relative arms 62 of relative safety devices 58 to stretch respective springs 64 and keep respective pawls 65 in their respective release positions (FIG. 5) enabling annular drum 3 to rotate freely about longitudinal axis 4. In this position, cam follower rollers 76 of levers 75 of safety devices 59 (FIG. 5) roll along respective portions of circular inner profile 77 of cam 66 to keep relative levers 72—in opposition to relative springs 78 and by means of the relative transmissions defined by relative pins 69, levers 70, and connecting rods 71—in respective stop positions (FIGS. 1 and 4), in which levers 72 are positioned with relative recesses 74 in plane S and facing pin 46 and pin 55 respectively. Consequently, any movement of pushers 44 and 53 towards their extracted work positions is prevented by respective pins 46 and 55 engaging relative levers 72.

At the end of its step, annular drum 3 is arrested (FIGS. 6 and 7) with one pocket 8 at loading station 23, and a further pocket 8 at unloading station 25. When annular drum 3 is arrested, cam follower rollers 76 of levers 75 of safety devices 59 (FIG. 7) engage respective recesses 79 on circular inner profile 77 of cam 66, so that relative levers 72 are moved by relative springs 78 out of the relative stop positions to release relative pins 46 and 55 and so allow pushers 44 and 53 to move into their extracted work positions.

At this point, the two linear electric motors 47 and 56 are operated to move pusher 44 through the pocket 8 at unloading station 25 and unload an at least partly completed carton 26, and to move pusher 53 through the pocket 8 at loading station 23 to accompany, as it moves back, insertion inside pocket 8 of a group 21 for packing.

When moved from their withdrawn rest positions, pins 46 and 55 release and allow relative rocking arms 61 to rotate, clockwise in FIG. 6 and under the control of relative springs 64, about respective pins 60, so that relative pawls 65 engage relative stationary teeth 68 in plane S to prevent annular drum 3 from rotating about longitudinal axis 4 until both pushers 44 and 53 are returned to the withdrawn rest positions, in which pins 46 and 55 act on relative arms 62 to restore relative pawls 65 to their release positions.

In normal operating conditions, undesired or wrong start-up of electric motor 18, when pawls 65 are positioned engaging relative teeth 68, and/or undesired or wrong start-up of linear electric motors 47 and 56, obviously produces an immediate increase in stress and consequent emission, by known detection and alarm systems, of a signal for either arresting cartoning machine 1 immediately, or only after a given number of unsuccessful reset attempts.

Figure 8:
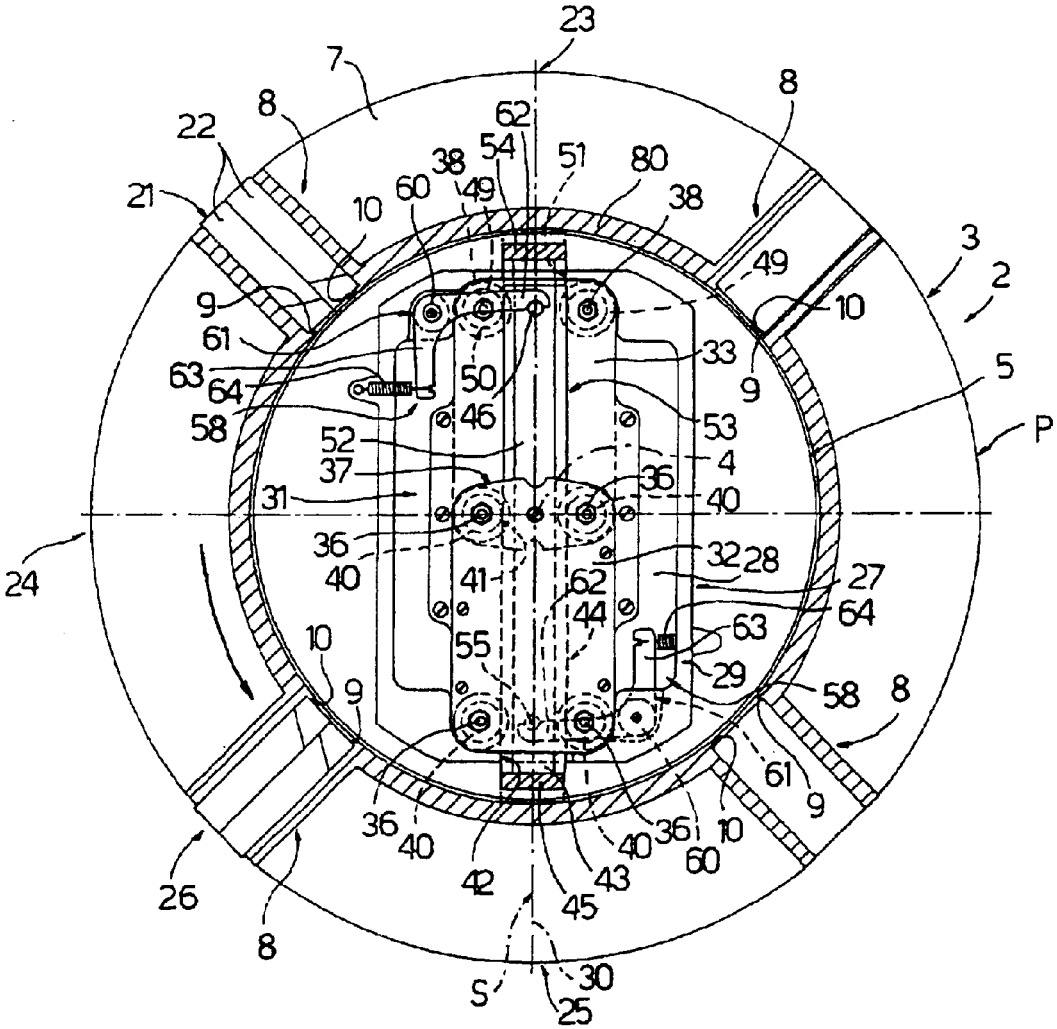
FIG. 8 is similar to FIG. 2, and shows a second preferred embodiment of the packing wheel according to the present invention.

In the FIG. 8 embodiment, safety devices 59 are replaced by a cylindrical tube 80 coaxial with longitudinal axis 4, connecting the inner peripheries of front annular flange 6 and rear annular flange 7, and having openings 10. Obviously, the function of tube 80 is to prevent pushers 44 and 53 from engaging the space between flanges 6 and 7 when annular drum 3 is moving.

What is claimed is:

1. An operating wheel of a packing machine (1) for packing products (21), the operating wheel (2) comprising a fixed central body (5) having a longitudinal axis (4); an annular drum (3) coaxial with said longitudinal axis (4) and surrounding said central body (5); a number of through pockets (8) carried by said annular drum (3) and each for receiving a respective said product (21); first drive means (18) for rotating said annular drum (3) in steps about said longitudinal axis (4) to feed said pockets (8) along an annular path (P) extending through a loading station (23) and an unloading station (25) for respectively loading and unloading said products (21); first and second push means (53, 44) carried by said central body (5) and for engaging respective said pockets (8) at said loading station (23) and said unloading station (25) respectively; and second drive means (56, 47) for imparting to said push means (53, 44) respective substantially radial reciprocating movements to and from respective withdrawn rest positions inside said annular drum (3) and through said respective pockets (8); the operating wheel (2) being characterized in that at least said second drive means (56, 47) are electric drive means; and by comprising a first safety device (58) for preventing said annular drum (3) from rotating about said longitudinal axis (4) when at least one of said push means (53, 44) engages a said respective pocket (8); and a second safety device (59; 80) for preventing said push means (53, 44) from moving from the respective said withdrawn positions when said annular drum (3) is rotating about said longitudinal axis (4).

2. An operating wheel as claimed in claim 1, wherein each of said second drive means (56, 47) comprises, for each of said push means (53, 44), a respective linear electric motor (56; 47).

3. An operating wheel as claimed in claim 1, wherein said first drive means (18) are electric drive means.

4. An operating wheel as claimed in claim 1, wherein said first and second safety devices (58, 59; 58, 80) are mechanical safety devices.

5. An operating wheel as claimed in claim 4, wherein said second safety device (59) comprises, for each of said push means (53, 44), a second stop member (72) fitted to said central body (5); and second stop means (46; 55) movable with the relative said push means (53; 44); said second stop member (72) being movable on said central body (5) between an interference position and a non-interference position with respect to a path travelled by said second stop means (46; 55), and cooperating, in said interference position, with said second stop means (46; 55) to lock the respective said push means (53, 44) in the respective withdrawn rest position; second elastic means (78) being provided to move said second stop member (72) into said non-interference position; and control means (69, 70, 71, 75, 76, 66) being provided to lock said second stop member (72) in said interference position when said annular drum (3) is rotating, and to allow the second stop member (72) to be moved by said second elastic means (78) into said non-interference position, when said annular drum (3) is stationary.

6. An operating wheel as claimed in claim 5, wherein said control means (69, 70, 71, 75, 76, 66) comprise, for each of said push means (53, 44), a second hinge pin (69) fitted in oscillating manner to said central body (5) and parallel to said longitudinal axis (4); a crank (70) and a connecting rod (71) interposed between said second hinge pin (69) and said second stop member (72), said crank (70) oscillating with said second hinge pin (69) to move said second stop member (72) between said engaged and release positions; and cam means (75, 76, 66) carried by said annular drum (3) to control oscillation of said second stop member (72).

7. An operating wheel as claimed in claim 6, wherein said cam means (75, 76, 66) comprise a cam (66) coaxial with said longitudinal axis (4); and cam follower means (75, 76) interposed between said cam (66) and said second hinge pin (69); said cam follower means (75, 76) oscillating with said second hinge pin (69), and being maintained contacting said cam (66) by said second elastic means (78).

8. An operating wheel as claimed in claim 4, wherein said second safety device (80) comprises a tubular body (80) coaxial with said longitudinal axis (4), integral with said pockets (8), and defining an inner portion of said annular drum (3); said tubular body (80) being located radially inwards with respect to said pockets (8), and having, at each said pocket (8), an opening (42) for the passage of said push means (53, 44).

9. An operating wheel as claimed in claim 1, wherein said first safety device (58) comprises, for each of said push means (53, 44), a respective pawl (65) fitted to said central body (5); and a respective first stop member (68) carried by said annular drum (3) and movable with the annular drum (3) about said longitudinal axis (4); first elastic means (64) being provided to move said pawl (65) into an engaged position engaging said respective first stop member (68); and transmission means (60, 62, 46; 69, 62, 55) being interposed between said pawl (65) and the respective said push means (53; 44) to lock said pawl (65) in a release position releasing the relative said first stop member (68) when the respective push means (53; 44) are in the respective withdrawn rest position.

10. An operating wheel as claimed in claim 9, wherein said transmission means (60, 62, 46; 69, 62, 55) comprise, for each of said push means (53, 44), a first hinge pin (60) fitted to said central body (5) and parallel to said longitudinal axis (4), said pawl (65) oscillating with said first hinge pin (60) between said engaged and release positions; an arm (62) fitted to said first hinge pin (60); and first stop means (46; 55) movable with the relative said push means (53; 44) and cooperating with the respective said arm (62) to oscillate the respective said first hinge pin (60).

11. An operating wheel as claimed in claim 10, wherein said first stop means (46; 55) comprise, for each of said push means (53, 44), a stop pin (46; 55) movable with the respective said push means (53; 44) and parallel to said first hinge pin (60); each said arm (62) being so positioned as to be engaged by the respective said stop pin (46; 55) when the respective said push means (53; 44) near the respective said withdrawn rest position.

12. An operating wheel as claimed in claim 10, wherein said arm (62) is an arm of a rocker arm (61) pivoting on said first hinge pin (60); said rocker arm (61) comprising a further arm (63); and said first elastic means (64) being interposed between said further arm (63) and said central body (5).

13. An operating wheel as claimed in claim 10, wherein said first and second stop means (46; 55) are defined, for each of said push means (53, 44), by a common stop pin (46; 55) parallel to said longitudinal axis (4) and movable with the respective said push means (53, 44).

14. An operating wheel as claimed in claim 9, wherein said cam (66) comprises a first profile cooperating with said pawl (65) and having said first stop members (68); and a second profile (77) cooperating with said cam follower means (75, 76); said second profile (77) being a circular profile having a number of recesses (79); and said cam follower means (75, 76) engaging one of said recesses (79) when said annular drum (3) is stationary.

* * * * *

UNITED STATES PATENT AND TRADEMARK OFFICE

CERTIFICATE OF CORRECTION

PATENT NO. : 6,945,009 B2 
APPLICATION NO. : 10/901225
DATED : September 20, 2005
INVENTOR(S) : Mario Spatafora et al.

It is certified that error appears in the above-identified patent and that said Letters Patent is hereby corrected as shown below:

Title page,
Item [73], Assignee, should read -- G.D SOCIETA' PER AZIONI, Bologna (IT) --.

Signed and Sealed this

Twentieth Day of June, 2006

JON W. DUDAS
*Director of the United States Patent and Trademark Office*